US010165905B2

(12) United States Patent
Sander et al.

(10) Patent No.: US 10,165,905 B2
(45) Date of Patent: Jan. 1, 2019

(54) SHOWER BASE

(71) Applicant: Sander and Sons, Inc., Littleton, CO (US)

(72) Inventors: Michael Sander, Littleton, CO (US); Philip Sander, Littleton, CO (US)

(73) Assignee: Sander and Sons, Inc., Littleton, CO (US)

( * ) Notice: Subject to any disclaimer, the term of this patent is extended or adjusted under 35 U.S.C. 154(b) by 0 days.

(21) Appl. No.: 15/400,057

(22) Filed: Jan. 6, 2017

(65) Prior Publication Data

US 2017/0196413 A1 Jul. 13, 2017

Related U.S. Application Data

(60) Provisional application No. 62/278,262, filed on Jan. 13, 2016.

(51) Int. Cl.
*A47K 3/40* (2006.01)

(52) U.S. Cl.
CPC ..... *A47K 3/40* (2013.01)

(58) Field of Classification Search
CPC ..... A47K 3/40
USPC ..... 4/596–614
See application file for complete search history.

(56) References Cited

U.S. PATENT DOCUMENTS

| | | | |
|---|---|---|---|
| D351,019 | S | 9/1994 | Moore et al. |
| D367,522 | S | 2/1996 | Debs |
| D480,455 | S | 10/2003 | Painter et al. |
| 6,990,695 | B2 | 1/2006 | Grayson |
| D596,722 | S | 7/2009 | Hisey |
| 7,752,686 | B2 | 7/2010 | Polimeno |
| 8,181,288 | B1 | 5/2012 | Davis, Jr. |
| 8,209,795 | B2 | 7/2012 | Cook |
| 8,474,069 | B1 | 7/2013 | Whitinger |
| 8,677,521 | B2 | 3/2014 | Stimpson |
| 8,789,316 | B2 | 7/2014 | Cook |
| 8,850,633 | B2 | 10/2014 | Erlebach |
| 9,334,638 | B1 | 5/2016 | Kirby |

(Continued)

OTHER PUBLICATIONS

American Standard "Installation Instructions—Ciencia Solid Surface Bases" 2 pages, copyright AS America Inc. 2012.

(Continued)

*Primary Examiner* — Lori Baker
(74) *Attorney, Agent, or Firm* — Trenner Law Firm, LLC; Mark D. Trenner

(57) ABSTRACT

A curbless shower base includes a subbase structure having a sloped floor and a zero entry. At least one side wall can be mounted flush with drywall during an installation so that a tile or other wall covering is installed flush over the at least one side wall to a floor of the subbase structure A drainage channel in the subbase structure extends substantially from a first side of the subbase structure to an opposite second side of the subbase structure. The drainage channel is sloped from the first side of the subbase structure to a drain outlet in the drainage channel, and the drainage channel is sloped from the second side of the subbase structure to the drain outlet in the drainage channel. A drain assembly has a drain outlet to connect with plumbing during the installation. A protective structure of the drain assembly at least partially surrounds the drain outlet.

8 Claims, 15 Drawing Sheets

(56) References Cited

U.S. PATENT DOCUMENTS

| | | | | |
|---|---|---|---|---|
| 2008/0222891 | A1* | 9/2008 | Cook | A47K 3/40 29/890.141 |
| 2014/0175700 | A1* | 6/2014 | Cook | B29C 45/14065 264/297.2 |
| 2014/0178518 | A1* | 6/2014 | Cook | B29C 45/2673 425/183 |
| 2017/0239864 | A9* | 8/2017 | Cook | B29C 45/2673 |
| 2017/0311764 | A1* | 11/2017 | Fine | A47K 3/405 |

OTHER PUBLICATIONS

Co-owned Design U.S. Appl. No. 29/551,474 titled "Shower Base" of Michael Sander and Philip Sander, assigned to Sander and Sons, Inc. filed Jan. 13, 2016, Not Yet Published by the USPTO.

* cited by examiner

SHOWER BASE

CROSS REFERENCE TO RELATED APPLICATIONS

This application claims the priority benefit of U.S. Provisional Patent Application No. 62/278,262 filed Jan. 13, 2016 for "Shower Base," hereby incorporated by reference in its entirety as though fully set forth herein.

BACKGROUND

Preformed shower pans are commonly used in new construction and remodels to provide a ready-to-use floor instead of having to lay a tile floor. Typically, these shower pans are preformed from fiberglass or other materials and may be set in a bed of mortar to provide support for people to stand on while in the shower.

DETAILED DESCRIPTION

An example shower base is disclosed herein which includes a subbase structure, and a drainage channel. The example shower base may also include a drain assembly in the drainage channel. A drain grate may be provided over the drainage channel. In an example, a protective structure is provided adjacent the drain assembly.

Before continuing, it is noted that as used herein, the terms "includes" and "including" mean, but is not limited to, "includes" or "including" and "includes at least" or "including at least." The term "based on" means "based on" and "based at least in part on."

FIGS. 1-8 illustrate various views of an example shower base 10. In an example, the shower base 10 includes a subbase structure 12, and a drainage channel 14. The example shower base 10 may also include a drain assembly 16 (visible in FIG. 2) in the drainage channel 14.

Figure 1:
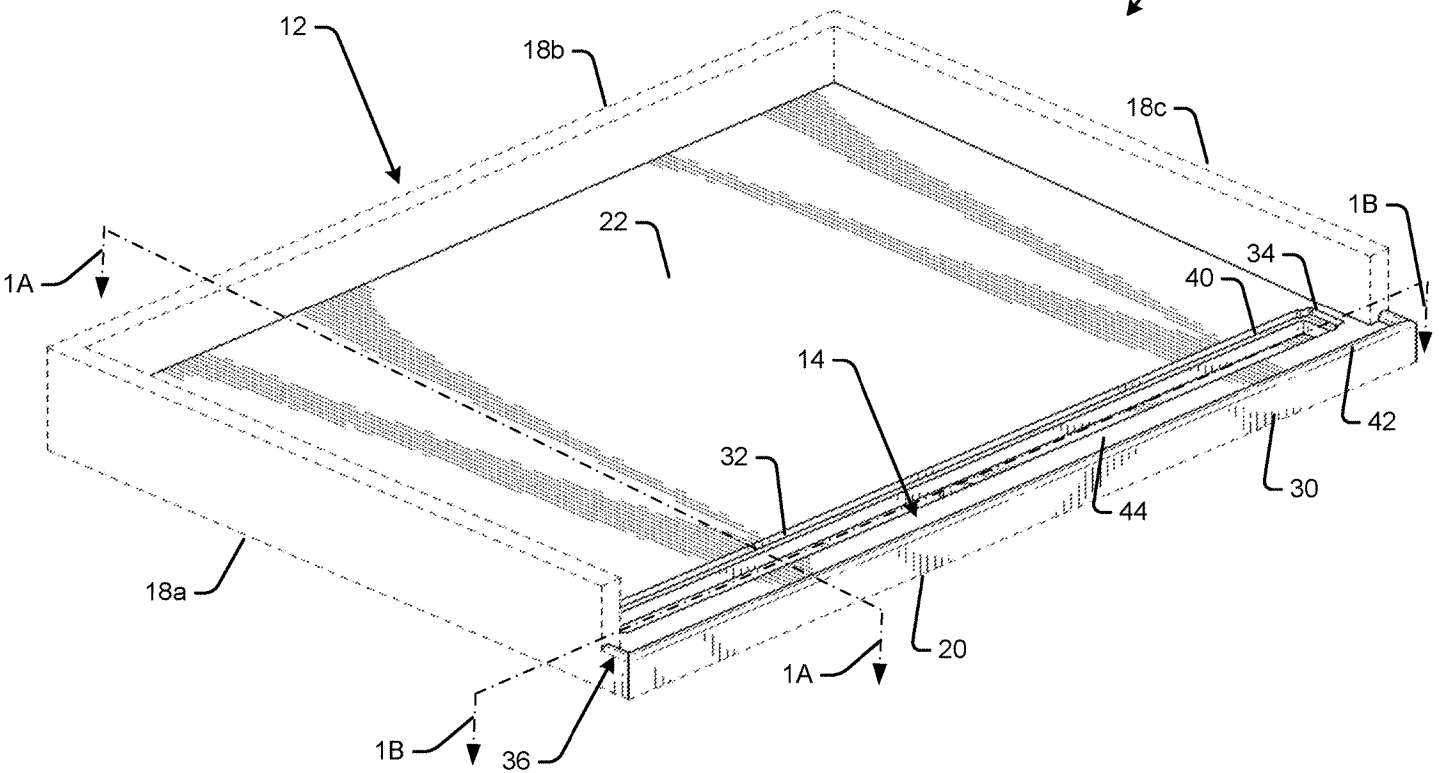
FIG. 1 is a top perspective view of an example shower base with a front drainage.
Figure 1A:
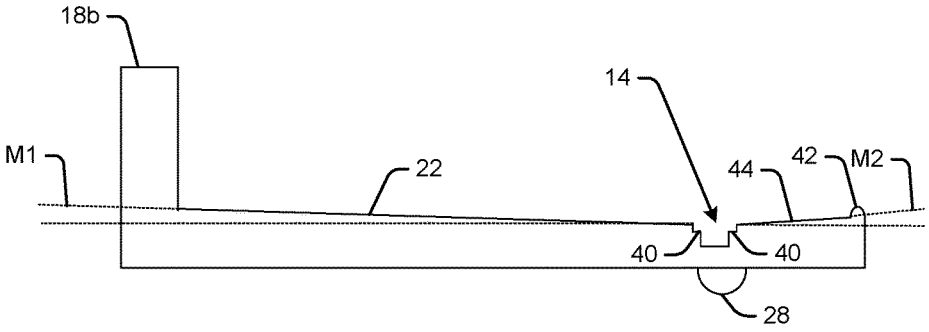
FIG. 1A is a side cutaway view of the example shower base, taken along lines 1A-1A in FIG. 1.

In an example, the floor 22 of the shower base is sloped (e.g., 2%) toward the drainage channel 14 (see, e.g., M1 and M2 in FIG. 1A). In another example, area 44 of the floor 22, may be substantially flat, and the sloped portion M2 may only be a portion (e.g., the front portion) of area 44. In another example, portion M2 may be radiused (e.g., 3/16 to ¼" long), instead of sloped, where the bump transitions onto the flat area of the base before the drain channel.

Figure 1B:
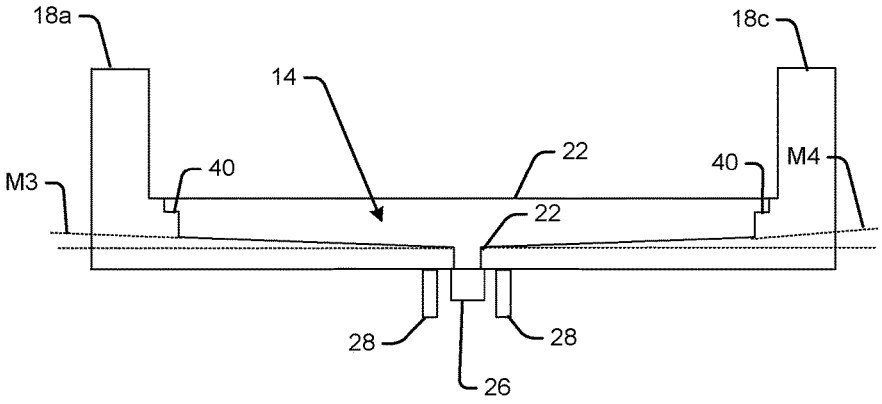
FIG. 1B is a front cutaway view of the example shower base, taken along lines 1B-1B in FIG. 1.
Figure 2:
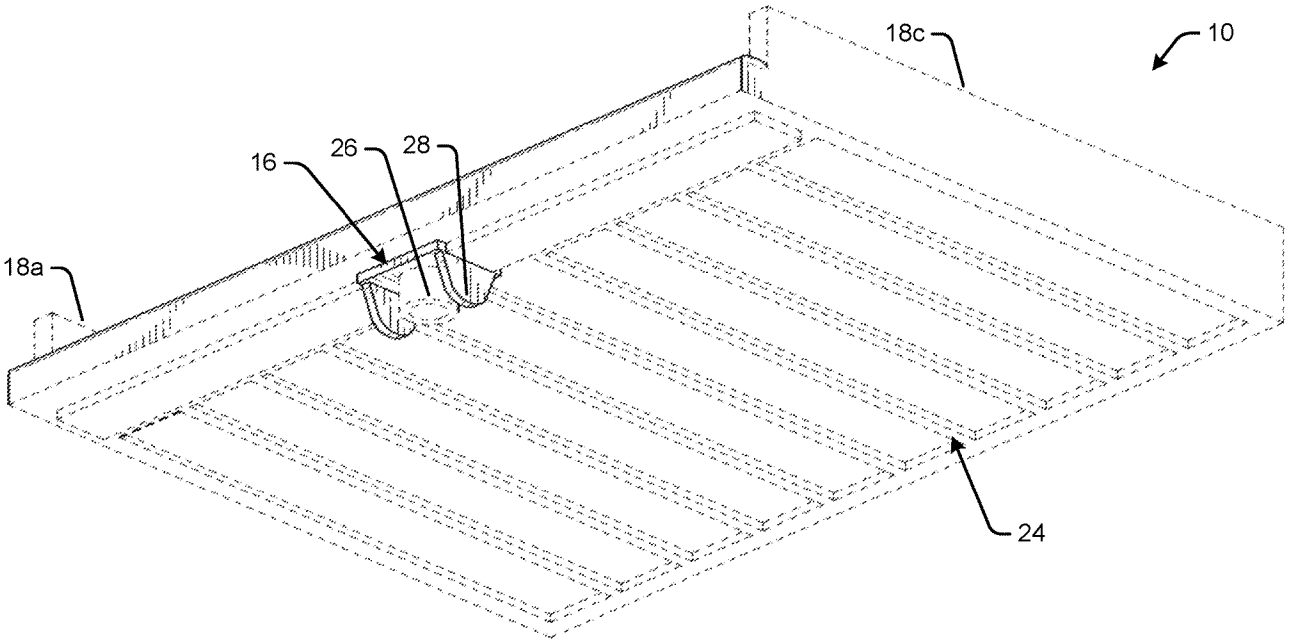
FIG. 2 is a bottom perspective view of the example shower base shown in FIG. 1.
Figure 3:
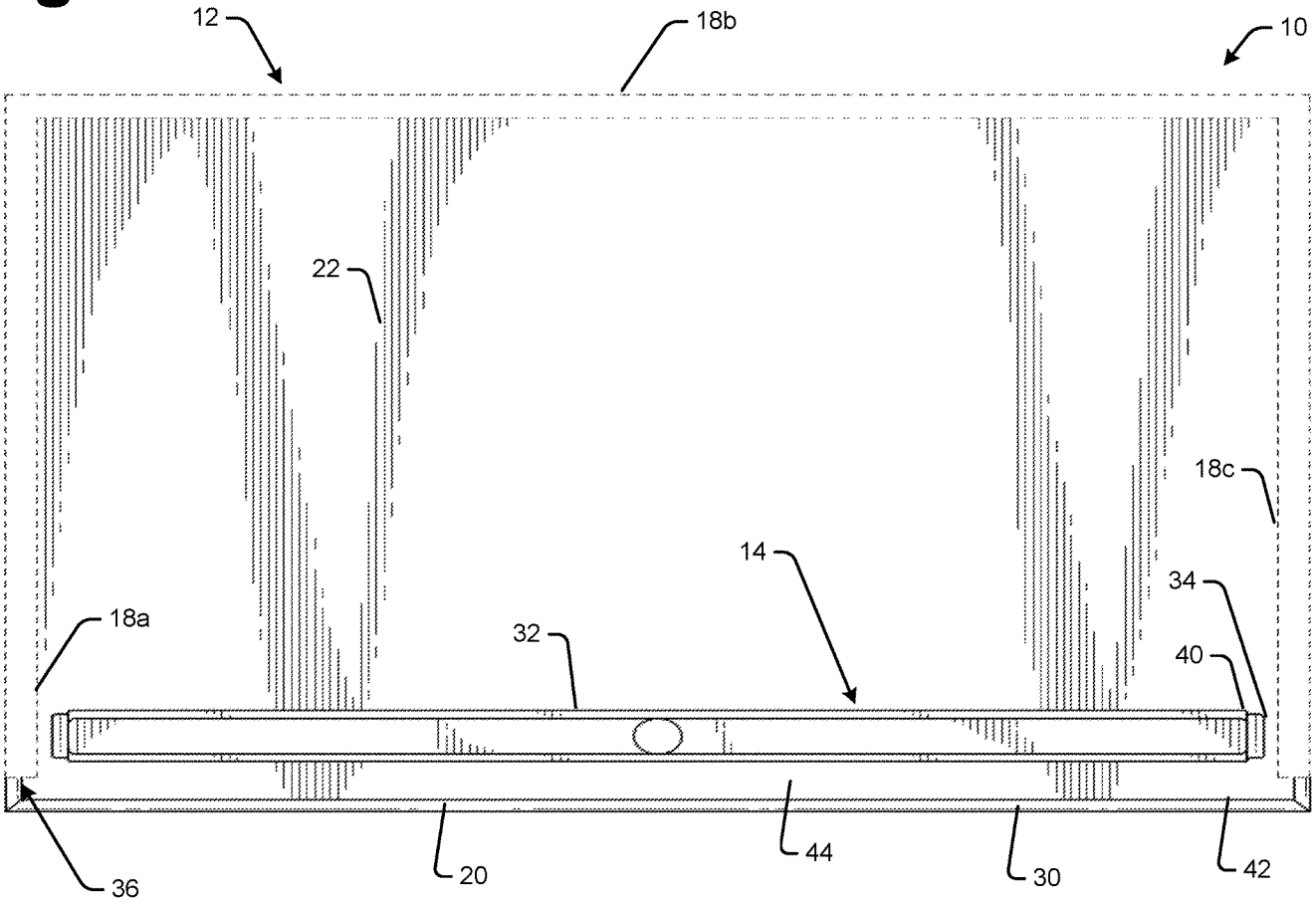
FIG. 3 is a top view of the example shower base corresponding to FIG. 1.
Figure 4:
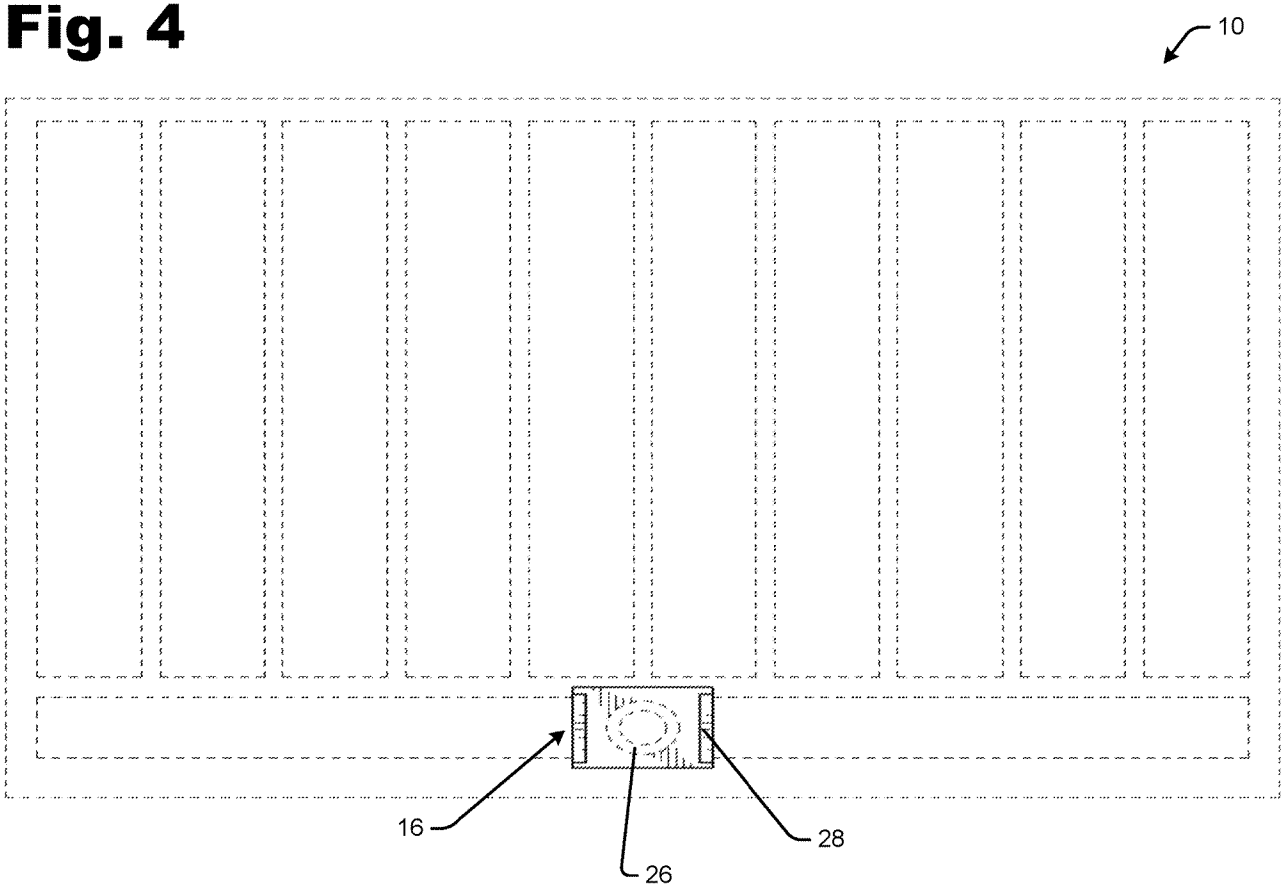
FIG. 4 is a bottom view of the example shower base corresponding to FIG. 2.
Figure 5:
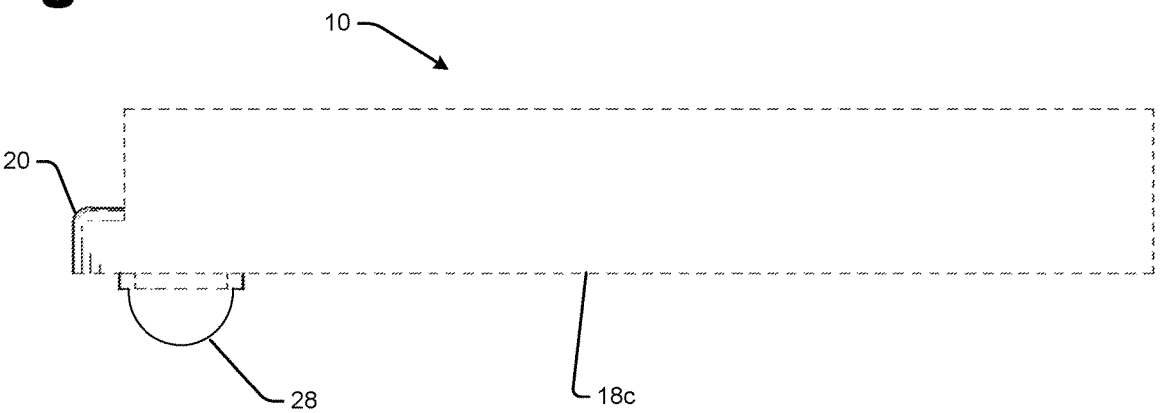
FIG. 5 is a right-side view of the example shower base corresponding to FIG. 1.
Figure 6:
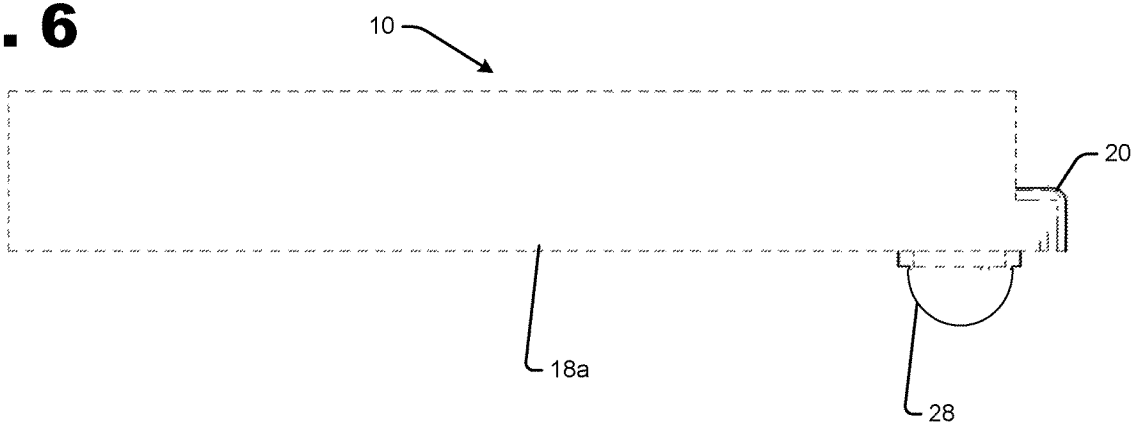
FIG. 6 is a left-side view of the example shower base corresponding to FIG. 1.
Figure 7:
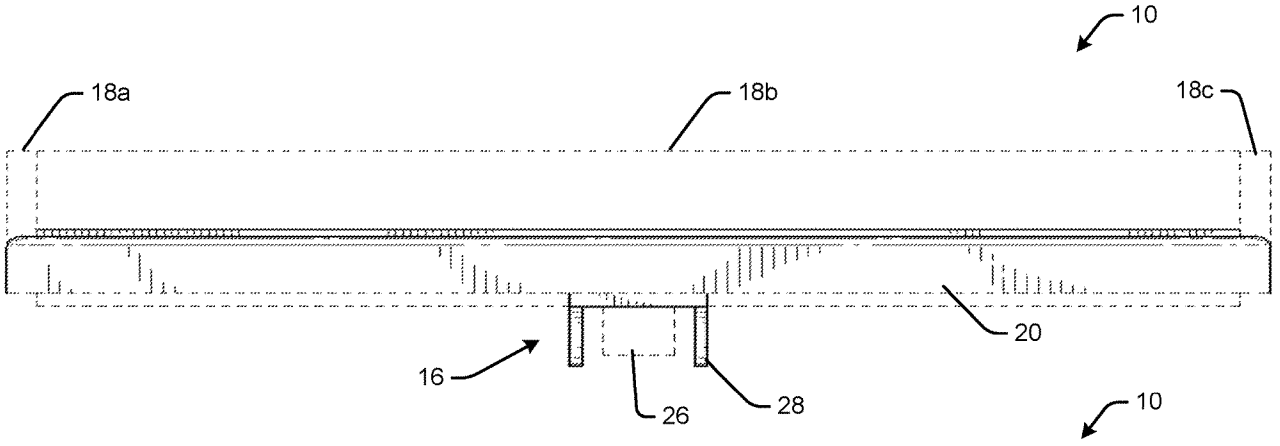
FIG. 7 is a front view of the example shower base corresponding to FIG. 1.
Figure 8:
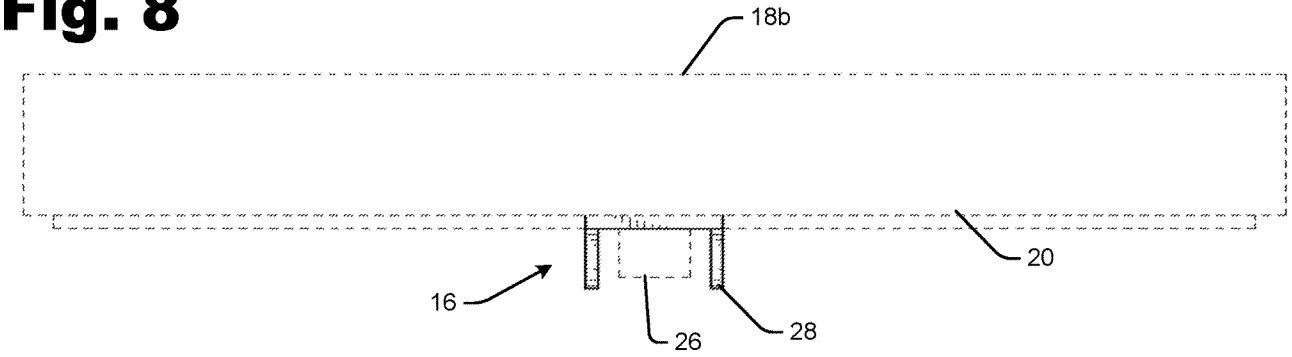
FIG. 8 is a back view of the example shower base corresponding to FIG. 1.

Further, the drainage channel 14 itself may be sloped toward the center to the drain assembly 16 (see, e.g., M3 and M4 in FIG. 1B). For example, the drainage channel 14 may have about a 2% slope from both the sides of the drain channel 14 toward an outlet provided in the center of the drain assembly 16. It is noted that in an example, M1=M2=M3=M4=about 2%. However, in other examples the slopes do not have to be equal, all may be unequal or some may be unequal. Likewise, in other examples the slopes do not have to be 2%.

Opening in the drain 14 for the drain outlet 26 (e.g., drain outlet 26 in FIG. 2) may be provided at any suitable location along the length of the drainage channel 14. The floor of drain channel 14 can slope from either or both edges toward the opening for the drain outlet. This enables maximum flow of water to the drain opening and eliminates standing water in the drain channel 14.

The shower base 10 may be provided with one or more sidewall. The example illustrated in FIG. 1 includes three sidewalls 18*a-c* and a front 20. The shower base walls 18*a-c* and front 20 are shown in broken lines to indicate that other configurations are possible.

The example shower base 10 may be installed in an area of a house (or other facility) having three framed walls. The sidewalls may be the approximate thickness of drywall placed over the framed walls of the house. As such, the drywall can be installed above the sidewalls 18*a-c* to provide a flush finish between the drywall on the walls of the house and the sidewalls 18*a-c* of the shower base 10. This configuration enables tile or other finish to lay flush over both the drywall and the sidewalls 18*a-c* so that the sidewalls 18*a-c* are not visible after installation of the tile or other finish.

Other configurations are also contemplated. In another example configuration, two sidewalls may be provided, where only two walls of the house are to be tiled. For example, the door and a glass sidewall may be provided on the other two sides of the shower base.

The bottom of the shower base 10 is shown in broken lines (e.g., FIG. 2 and FIG. 4) to indicate that other configurations are possible. In an example, the bottom of the shower base 10 may include a molded support structure 24. However, any support structure (e.g., a foam base), and even no support structure, may be provided in other configurations.

In an example, the drain assembly 16 of the shower base 10 may include a drain outlet 26 or connection for a drain pipe or other plumbing in the house. The drain assembly 16 may also include a protective structure 28 (e.g., FIGS. 2 and 4-8) adjacent the drain outlet 26 on the underside of the shower base 10. The protective structure may be any shape (e.g., semi-circular, oblong, square, etc.). The protective structure 28 may protect the drain outlet 26 during installation of the shower base 10. For example, the protective structure 28 may reduce or altogether prevent the drain outlet 26 from being hit or knocked during transport and/or installation of the shower base, and thus possibly broken off.

In an example, the drain outlet 26 is a permanently attached 2 inch PVC drain connection. The drain connection enables a major portion of the drain assembly to drop into a slot in a three-quarter inch bathroom subfloor.

Once installed the front of the base is only three-quarters of an inch above the subfloor, enabling a standard tile finished floor to be laid with a combination of either a one-quarter inch or one-half inch backer board, and resulting in the tile surface being substantially flush with a top front edge 30 of the shower base 10. As such the shower base 10 can be installed with a flush or "zero" entry without needing ramps or having to remove the entire sub floor, adding additional cross members and support structure between the joists, and then installing a base to achieve a flush access, as has traditionally been required with tile.

In an example, the floor 22 of the shower base 10 has a uniform 2% slope across the width from the rear to the front of the drain interface 32. This provides a unique ability for base depth dimensions in excess of all other bases with centered drains, as center drain positioning cannot maintain a required 2% slope from all sides of large bases that are currently commercially available.

In addition, the length of the drain channel 14 and strainer mounting ledge where the drain channel 14 interfaces 34 to the vertical base side walls 18*a* and 18*c* is designed so that the ledge stops ½ inch from both wall sides. Accordingly, when wall finish materials (e.g., tile) are installed over the side walls 18*a* and 18*c*, it completely covers this void between interface 34 and the side walls 18*a* and 18*c* so that water cannot escape from the shower side of the drain trough 14. This may also create a void under the finished wall material on both sides so that once the strainer is installed it can be shifted left or right slightly on the ledge to lock it into place.

In an example, the vertical side walls 18*a-c* on the shower base 10 end about one-inch from the front 20 of the base (e.g., as illustrated by the interface 36 between front edge of side wall 18*a* and the front face of front 20). This creates a unique interface 36 for drywall on the outside of the front 20 to be extended into the shower base 10 and up to the side wall 18*a* and 18*c*. This intersection 36 (e.g., about 1 inch off the front of the shower base 10) also becomes the point where a door and front glass panel channels intersect, thereby sealing and leaving an inside wet area and outside dry area of the shower front 20.

In an example, the shower base 10 may include a three-sixteenth inch high by three-sixteenth inch wide smooth radius "bump" (or small wall 42) on the top front which may run the entire length of the base. The area 44 (see, e.g., FIGS. 1 and 1A-1B) between the front of the "bump" 42 and the drain channel 14 is about two and one-eighth inches, providing an area for door and glass panel installation. The "bump" 42 may also provide a water retention mechanism so that water that drips off the inside of a door does not flow out onto the surrounding floor. The "bump" 42 may also serve as an ADA (Americans with Disabilities Act) compliant retention bump for wheel chairs, and/or provide a level of water retention should doors and glass panels otherwise not be used.

In an example, the first or front six inches of the shower base 10 are flat. This provides a flat area for the drain channel, glass, and door mounting area, and may also slow water seepage at the interface from the 2% slope of the base rear onto the flat drain body area.

It is noted that the shower base 10 may be manufactured of any suitable material. In an example, the shower base 10 is manufactured of an acrylic solid material. However, the shower base 10 may also be manufactured of other engineered or naturally occurring material(s).

It is also noted that the shower base 10 can be made in stock industry sizes, and are also readily manufactured in nonstandard custom sizes. In addition, the drain outlet 26 can be moved (e.g., to the left or right) of center within the drain channel 14 (e.g., to avoid obstructions encountered within the joists space). This may reduce or altogether eliminate the need for field modifications to accommodate drain obstructions.

Figure 9:
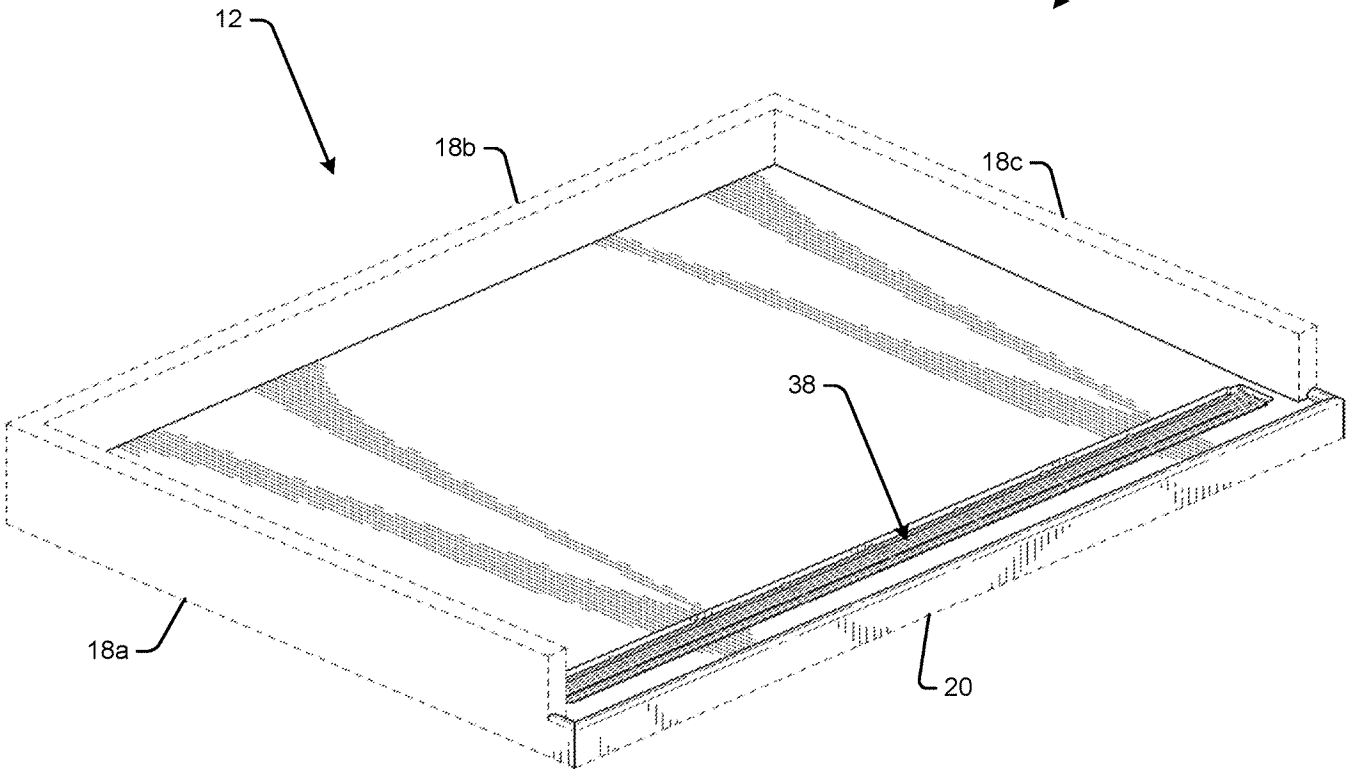
FIG. 9 is another top perspective view of the example shower base of FIG. 1 with a drainage grate.

FIG. 9 is top perspective view of the shower base 10 with a drainage grate 38. The drainage grate 38 shown is only illustrative, as other grates (and even no grate) may be provided. The drain grate 38 may be provided over the drainage channel 14. The drain grate 38 may be removable. For example, the drain grate 38 may rest on a support ledge 40 (see, e.g., FIGS. 1 and 1A-1B) around at least a portion of the perimeter of the drainage channel 14.

Before continuing, it should be noted that the examples described above are provided for purposes of illustration, and are not intended to be limiting. Other devices and/or device configurations may be utilized to carry out the operations described herein.

Figure 10:
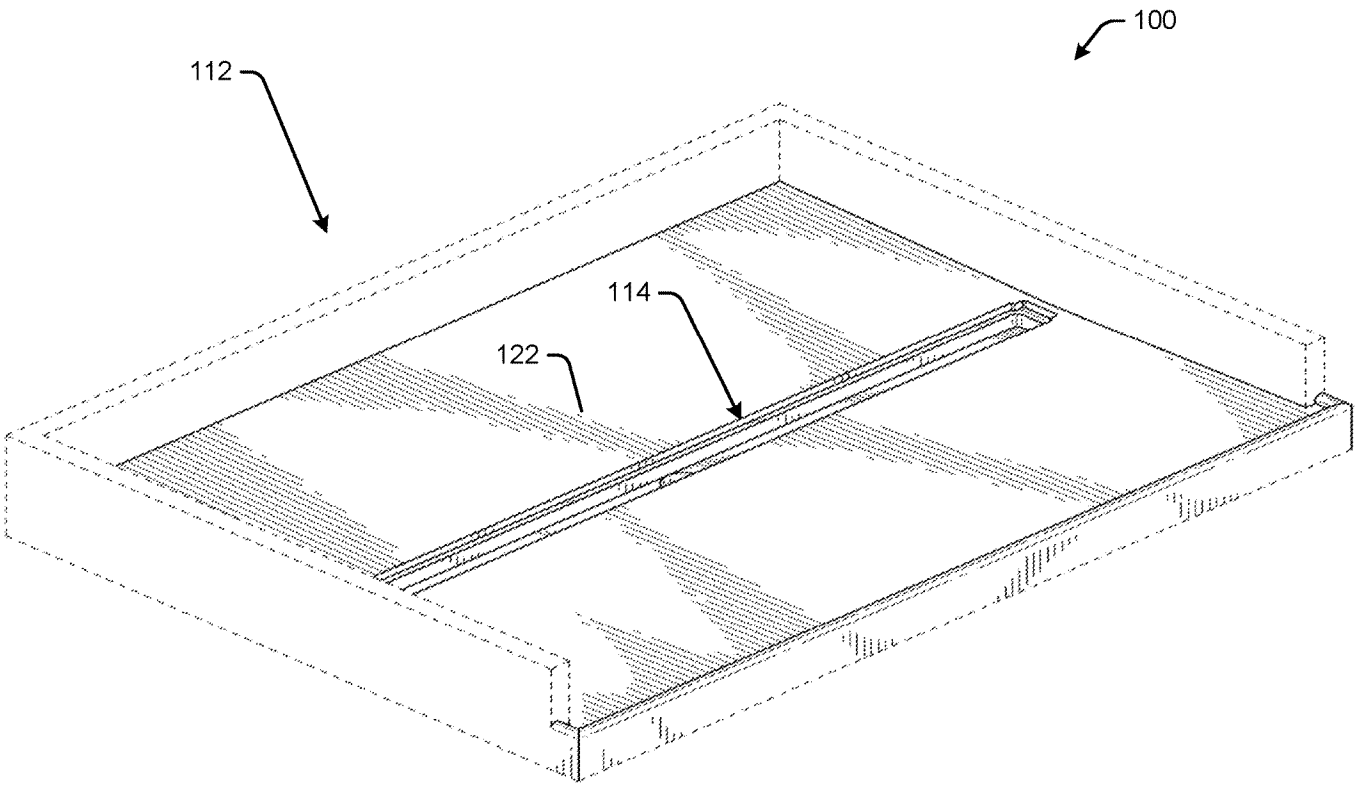
FIG. 10 is a top perspective view of another example shower base, with a center drain.
Figure 11:
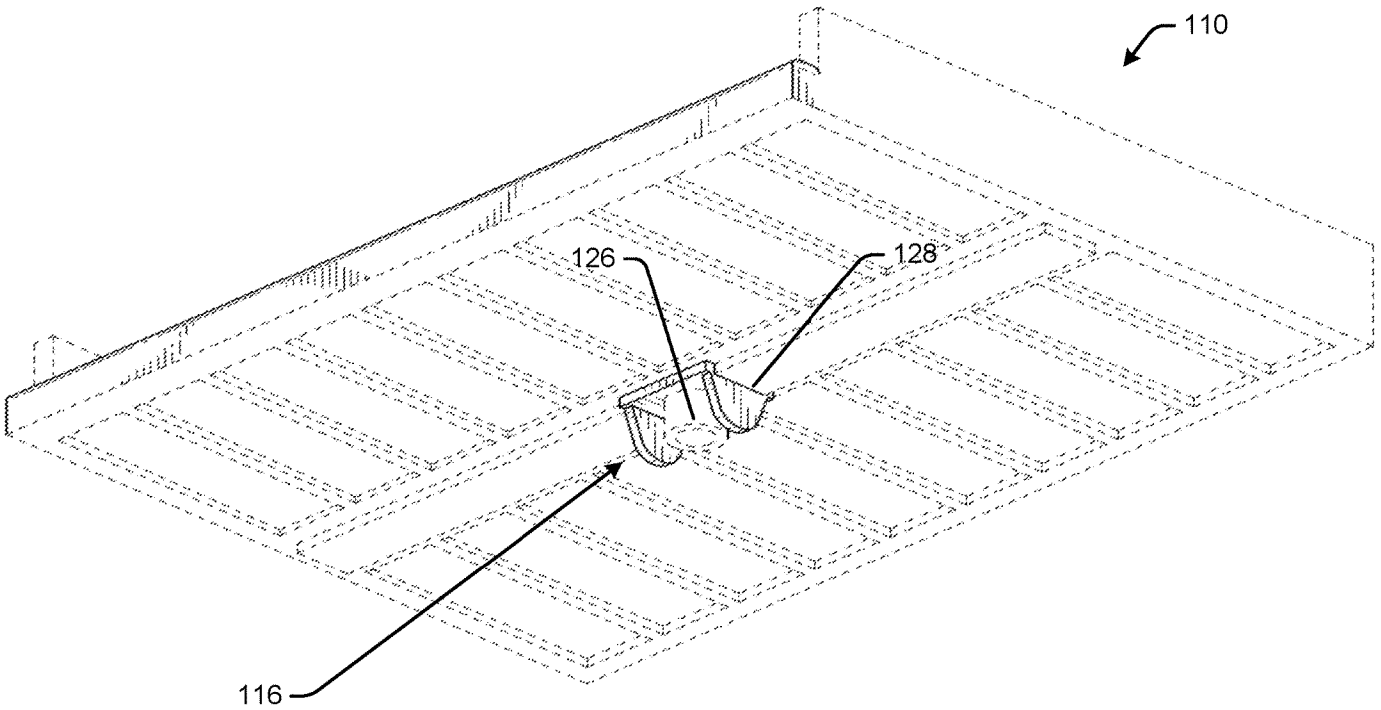
FIG. 11 is a bottom perspective view of the shower base shown in FIG. 10.

FIG. 10 is a top perspective view of another example shower base 100, with a center drainage. FIG. 11 is a bottom perspective view of the shower base 100 shown in FIG. 10. The shower base 100 again includes a subbase structure 112, and a drainage channel 114. The example shower base 100 may also include a drain assembly 116 connecting the drainage channel 114 with plumbing in the house via drain outlet 126. Protective structure 128 may also be provided, as already described above for shower base 10.

In this example, the floor 122 of the shower base 100 is sloped from the front and also sloped from the back, both toward the drainage channel 114 in approximately the center of the floor 122. Again, the drainage channel 114 itself may be sloped toward the center to the drain assembly. Of course, other positions of the drainage channel 114 are also contemplated.

The shower base disclosed herein provides a single-piece, solid-surface solution which enables complex configurations, custom sizes, and custom colors. As noted above, the shower base may include one or more side wall. Another example configuration enables a full glass panel that can be installed on the left, right, or both sides of the shower base. In an example, this configuration has a curb for mounting the glass to the base.

Figure 12:
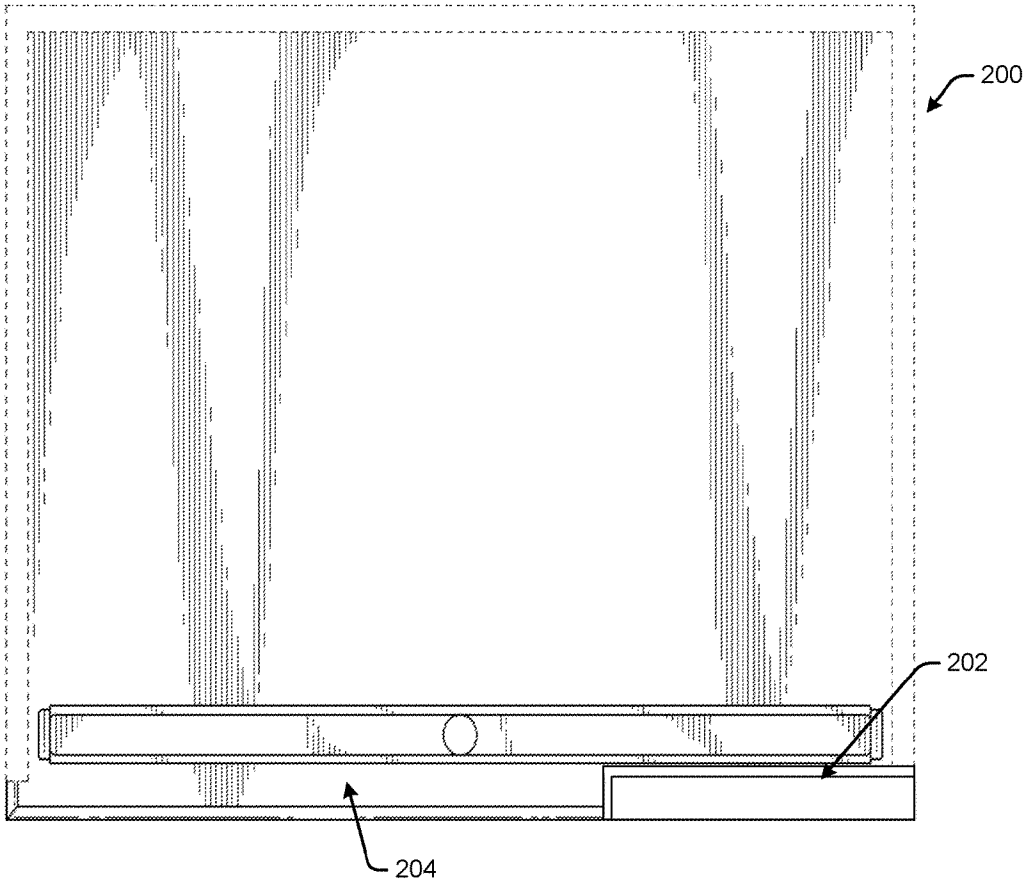
FIG. 12 shows another example shower base.

FIG. 12 shows another example shower base 200. The example configuration of shower base 200 is a four-wall shower base for showers that have a vertical full or half wall in a portion 202 of the front of the shower in addition to a door opening 204. Another example (not shown) may include a rear drain. It is noted that the "bump" or ridge may be included as shown, but other examples may not include the bump.

Figure 13:
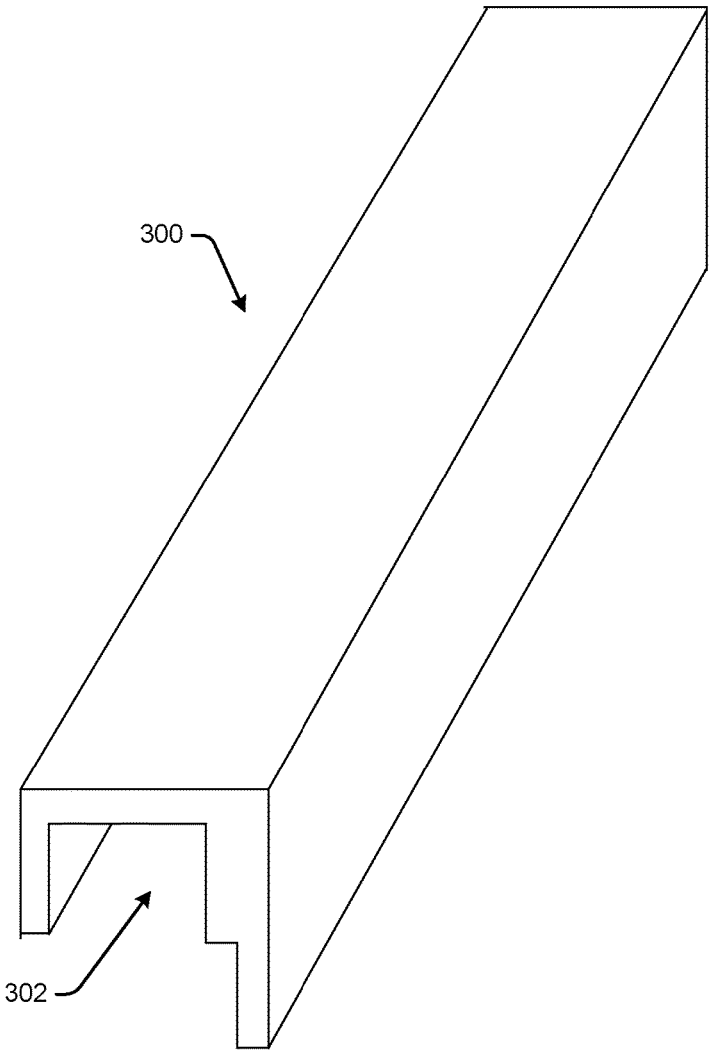
FIG. 13 shows a removable front curb for a shower base.

FIG. 13 shows a removable front curb 300 for a shower base. This curb can be provided during manufacture of the shower base, or may be added/removed after installation using a separate install kit. In an example, the front curb 300 may include an internal channel 302 so that it can be installed over the "bump" 42 in shower base 10 without moving. The install kit may also include an adhesive to make the installation permanent or semi-permanent.

Figure 14A:
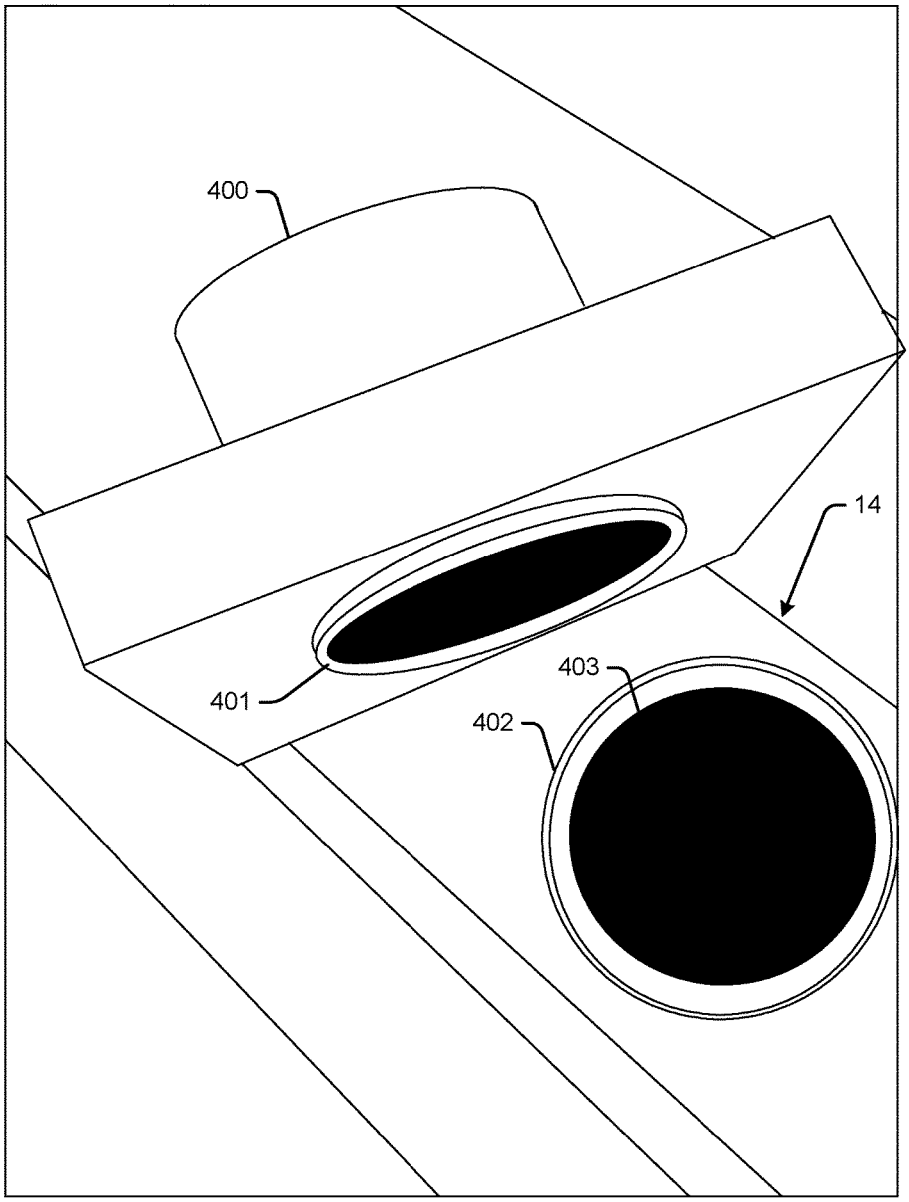
FIGS. 14A-C illustrate an example drain receptor.
Figure 14B:
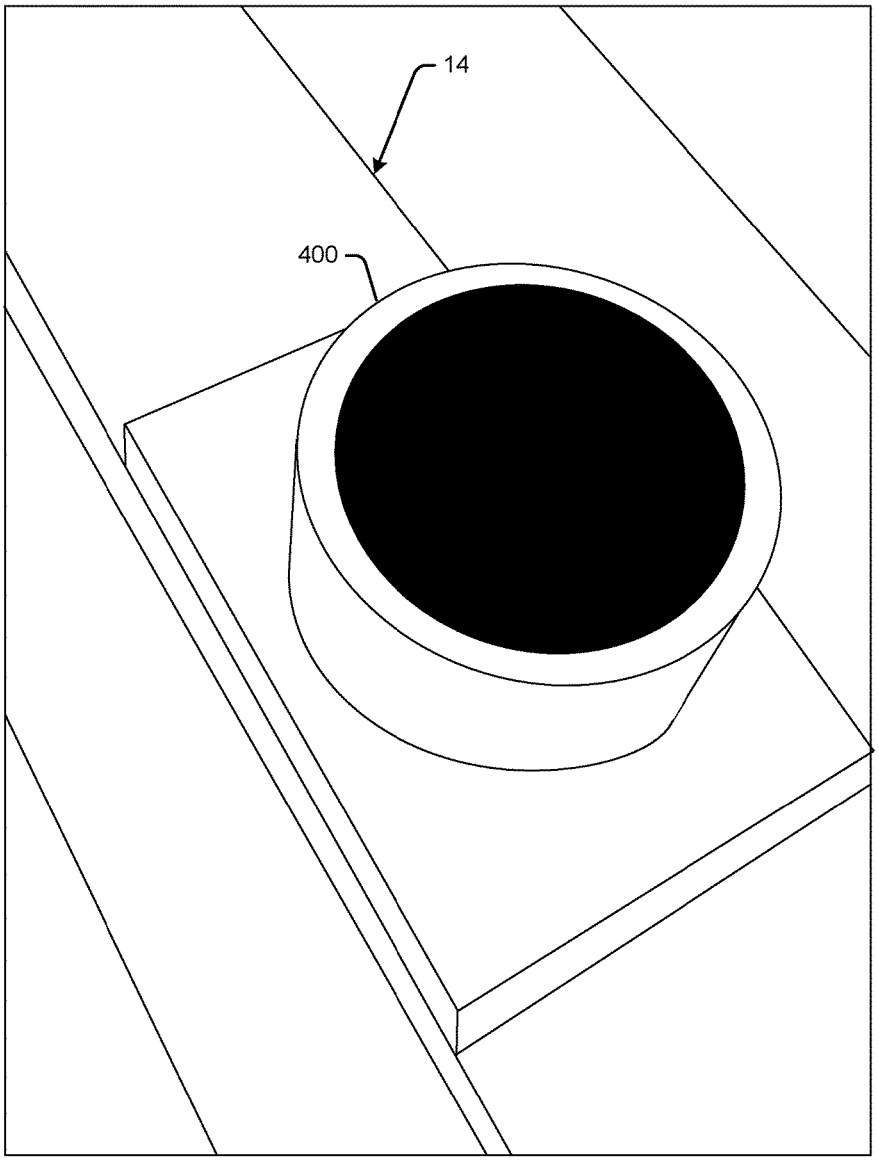
Figure 14C:
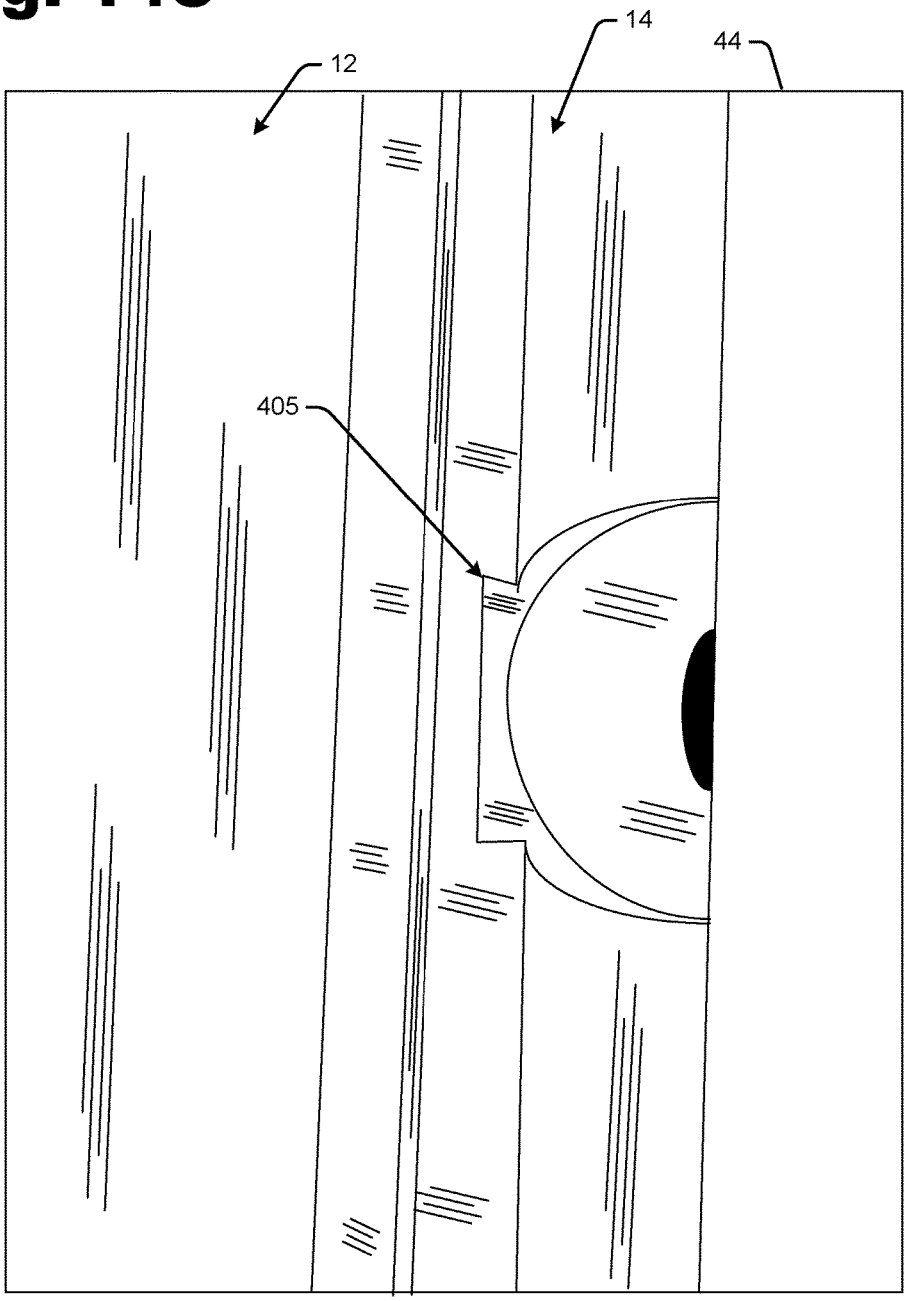

FIGS. 14A-C illustrate an example drain receptor 400. The example drain receptor 400 may be used instead of, or in addition to the drain assembly 16. The drain receptor 400 enables another unique feature of the shower base disclosed herein, that is, the narrow drain opening and strainer size.

Most commercial shower bases use very wide drain openings in order to accommodate connection via an industry standard four to five inches wide body drain slip connector to interface with onsite plumbing (e.g., a two inch PVC connection). These bases then have to use a very wide strainer from 3-5 inches or more in width, making the base and strainer look very institutional and not esthetically pleasing. In addition, these wide profile connectors increase the likelihood of having joist interference when trying to use them with bases with front linear drains which must drop into the subfloor to achieve a true flush entry with a finished three-quarter inch tile floor installation.

The shower base drain opening width on top of the base is only about one and three-quarter inches wide, allowing for a very narrow strainer while still maintaining a 5 gallon per minute flow capacity. This is only made possible by the drain receptor 400. The drain receptor 400 may be integrated into the shower base, and provides a drain connection interface.

When the drain receptor 400 interfaces to the drain body (e.g., shown attached in FIG. 14B), a one-eighth inch portion 401 of the PVC pipe fits into a recess 402 around drain opening 403 in the drain channel 14 in the shower base, making a secure connection (e.g., when bonded). In addition, the drain channel can be routed (405 in FIG. 14C) in one or both sides of the drain channel and widened three-eighth inches into the sides of the linear drain opening to match the drain pipe (e.g., the inside diameter of a 2 inch PVC pipe). This configuration enables a narrow (e.g., one and three-quarter inch) linear drain channel having a 2% slope within the drain channel (e.g., slope of the bottom of the drain channel) to achieve a drainage capacity of up to about 5 gallons per minute.

It is noted that the examples shown and described are provided for purposes of illustration and are not intended to be limiting. Still other examples are also contemplated.

The invention claimed is:

1. A curbless shower base, comprising:

a subbase structure having a sloped floor and a zero entry;

at least one side wall to mount flush with drywall during an installation, wherein a tile or other wall covering is installed flush over the at least one side wall to a floor of the subbase structure;

a drainage channel in the subbase structure, the drainage channel extending substantially from a first side of the subbase structure to an opposite second side of the subbase structure, the drainage channel sloped from the first side of the subbase structure to a drain outlet in the drainage channel, and the drainage channel sloped from the second side of the subbase structure to the drain outlet in the drainage channel;

a drain assembly having a drain outlet to connect with plumbing during the installation; and a protective structure of the drain assembly, the protective structure at least partially surrounding the drain outlet.

2. The curbless shower base of claim 1, wherein the sloped floor of the subbase structure has a uniform 2% slope across a width of the subbase structure from a rear portion to a front portion of the subbase structure.

3. The curbless shower base of claim 1, further comprising side walls on each side of the subbase structure, wherein the drain channel stops about one-half inch from the side walls on each side of the subbase structure to form a void, wherein the void is covered by wall finish material when the wall finish material is installed over each side wall.

4. The curbless shower base of claim 3, wherein each of the side walls on each side of the subbase structure is mounted about one inch from a front portion of the subbase structure to form an interface between a front edge of the at least one side wall and the front portion of the subbase structure, wherein the interface provides a point for a door and front glass panel channels to intersect, thereby maintaining an inside wet area and an outside dry area.

5. The curbless shower base of claim 1, further comprising:

a smooth radius bump formed around an outer perimeter of a front of the subbase structure; and a substantially flat portion formed between the smooth radius bump and the drain channel, the smooth radius bump and the flat portion providing a water retention mechanism even when a door is open or not even installed.

6. The curbless shower base of claim 1, further comprising a removable front curb.

7. The curbless shower base of claim 1, further comprising a drain receptor interfacing with the drain outlet, wherein the drain receptor is recessed into the drain channel to make a secure connection.

8. The curbless shower base of claim 7, wherein the drain channel is a narrow drain channel matching an inside diameter of the drain receptor to provide a 5 gallon per minute drain capacity.

* * * * *